United States Patent [19]

Burton

[11] 4,114,567

[45] Sep. 19, 1978

[54] IGNITION ENHANCEMENT CHAMBER FOR INTERNAL COMBUSTION ENGINE

[75] Inventor: Ralph Ashby Burton, Evanston, Ill.

[73] Assignee: Northwestern University, Evanston, Ill.

[21] Appl. No.: 775,250

[22] Filed: Mar. 7, 1977

[51] Int. Cl.[2] ..... F02P 23/02

[52] U.S. Cl. ..... 123/30 A; 123/32 C; 123/143 R; 123/191 SP

[58] Field of Search ..... 123/30 A, 30 E, 32 K, 123/32 L, 32 C, 32 A, 143 R, 143 B, 191 A, 191 B, 191 SP

[56] References Cited

U.S. PATENT DOCUMENTS

| | | | |
|---|---|---|---|
| 753,280 | 3/1904 | Low | 123/30 A |
| 1,159,341 | 11/1915 | Hobart et al. | 123/30 C |
| 2,752,907 | 7/1956 | Bodine | 123/191 B |
| 3,481,317 | 12/1969 | Hughes et al. | 123/143 R |
| 4,043,309 | 8/1977 | Kato et al. | 123/32 C |

FOREIGN PATENT DOCUMENTS

| | | | |
|---|---|---|---|
| 1,229,777 | 12/1966 | Fed. Rep. of Germany | 123/32 C |

*Primary Examiner*—Charles J. Myhre
*Assistant Examiner*—Craig R. Feinberg
*Attorney, Agent, or Firm*—Michael G. Berkman

[57] ABSTRACT

In an internal combustion engine an ignition enhancement and regulating chamber in fluid-flow communication with a principal combustion chamber of the engine through a restricted passage serving as a thermal isolater. The ignition enhancement chamber is characterized by a high surface area-to-volume ratio augmented by providing a heat retentive packing in the chamber, whereby the general operating efficiency of the engine is improved, and effective utilization of lean fuel mixtures is rendered feasible.

10 Claims, 8 Drawing Figures

IGNITION ENHANCEMENT CHAMBER FOR INTERNAL COMBUSTION ENGINE

BACKGROUND OF THE INVENTION

It is known in the field of internal combustion engineering that there are significant advantages in operating an internal combustion engine with "lean" fuel-to-air ratios. Such operation lowers the combustion temperature and tends to reduce objectionable nitrogen oxide and carbon monoxide emissions. Additionally, such operation improves the completeness of combustion and may actually also improve the overall engine efficiency as contrasted with the use of more conventional fuel-air mixture ratios. In spite of the recognized advantages in the use of such "lean" mixtures, several important problems have obviated the general adoption of such operation.

One practical difficulty is that the desired fuel-to-air ratios are near the limit of ignitability by a conventional spark system. Furthermore, poor distribution of the fuel charge may be responsible for one or more of the engine cylinders not being ignited. As a consequence, excessive quantitives of hydrocarbon fuel are dumped or discharged into the exhaust gases. It has been found that improved sparking does little to alleviate the situation. Some improvement is achieved through carburetion and modified manifolding, but not much. Better distribution of fuels through the use of injection systems has provided definite improvements, but at markedly increased cost and mechanical complexity. Moreover, none of these measures helps significantly when the fuel-to-air ratio is drastically reduced.

Another approach toward reaching a solution has been the utilization of stratified charge engines where injection of the fuel into the cylinder is used to provide a region of reasonably rich mixture in a charge of lean-to-average fuel-to-air ratio. Such systems have experienced some success but again at the expense of mechanical complexity, and even then with difficulty over a broad range of operating conditions. The fuel injection systems offer an advantage over a diesel engine only in the fact that the spark ignition makes possible the control of ignition lag, and thereby also makes possible multiple fuel operation.

Still another approach toward dealing with the problem has been the introduction of the CVCC engine, and a family of new derivative engines. In this system, a rich fuel-to-air mixture is held in a separate chamber provided with separate valving and is fired by a spark. The ignited fuel then rushes out of the separate chamber into the main chamber to accomplish ignition of the remaining, lean charge by turbulent mixing, among other effects.

While each of the above prior art approaches toward resolving the problems posed has contributed some insight, each offers only a significantly limited solution to the recognized problems. It is, therefore, the aim of the present invention to provide a simple mechanical system which incorporates all of the advantages of each of the prior art approaches without the requirement of charge stratification and without the requirement of special manifolding and injectors.

GENERAL DESCRIPTION OF THE INVENTION

The present invention relates generally to apparatus for improving the ignition and the fuel combustion systems of internal combustion engines. More particularly, the invention is directed to a simple yet highly significant modification of existing internal combustion engines to provide an effective ignition enhancement and regulating chamber.

It is an important feature of the present invention that the mechanical arrangement proposed avoids much of the complexity of the CVCC and other stratified charge engines.

It is a related feature of the present invention that the method and apparatus function well with simple carburetion in spite of the relatively poor fuel distribution of the conventional American engine. At the same time, through the practice of the invention it is possible to ignite a much leaner charge than has proven possible with unenhanced spark ignition.

It is an important advantage of the invention that it may be readily adapted as a retrofit on existing engine structures.

The versatility of the subject invention is indicated in that it is effective with internal combustion engines which utilize various different fuels including gasoline and number 2 fuel oil, only minor modifications being necessary as, for example, the utilization of somewhat richer fuel-to-air ratios in the latter situation.

As broadly viewed, the concept and principles of the present invention may be applied in at least two forms, these differing primarily in the relative dimensions of the mechanical parts involved, and in the fuel-to-air ratios which may be effectively accommodated.

Other objects, features, and advantages of the invention will become apparent upon a reading of the following description in conjunction with the accompanying drawing.

DESCRIPTION OF PREFERRED EMBODIMENTS

Figure 2:
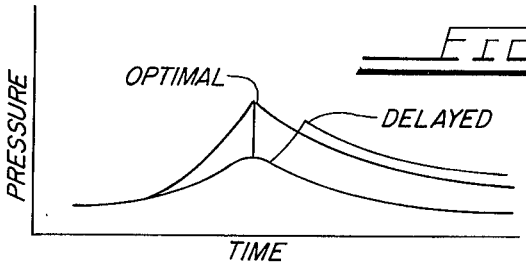
FIG. 2 is a graphic representation of optimal and delayed ignition in a pressure-time system.

The aims and objects of the invention are accomplished by providing, in an internal combustion engine 20 including a combustion chamber 24 and piston means 28 for cyclically compressing a gaseous fuel mixture in the combustion chamber 24, and valving means 32 and ignition means 36, a second or auxiliary chamber constituting an ignition enhancement chamber 40 (IEC). The IEC may be considered an engine appendix which is in fluid-flow communication with the combustion chamber 24 of the engine through an isolator 42 or restricted conduit 42*a*. The isolating conduit 42 prevents a circulating fresh charge contained in the combustion chamber 24 from entering the enhancement chamber 40 until near the end of the engine compression stroke. A heat-retentive ceramic or metallic material having extended surface is used as a packing 44 for the interior of the IEC. The invention is further described herebelow with reference to both moderately lean and extremely lean engine operation.

A. Ignition Enhancement for Moderately Lean Spark Ignition Engines

In one preferred embodiment of the invention the ignition enhancement chamber 24 is adapted for use in conjunction with engines having a moderately lean fuel-to-gas ratio. In ordinary operation, the engine may be started with a fuel mixture sufficiently rich for spark ignition and allowed to warm up until the filler or packing material 44 in the ignition enhancement chamber 40 is sufficiently hot to ignite a charge. In the system described, in each cycle, intake would occur conventionally and the IEC would remain filled with exhaust gas from the preceeding cycle. Upon beginning of the compression stroke the exhaust gas in the IEC will retreat and a front of fresh charge will enter the IEC or the engine appendix. The first combustibles which meet the hot filler material 44 will then react almost instantaneously. Depending upon the degree of constriction of the isolator 42 or entry tube 42*a* and upon the fuel-to-air ratio in the main combustion chamber 24 or cylinder, either of two events may occur:

1. a flame front may form at the point of ignition and may sweep out through the charge in the cylinder 24 or
2. the flame transit outward may be suppressed and only gas entering the porous medium or packing 44 will be reacted. In the latter situation there will be an increase in combustion gases in the IEC and a partial restriction of the entry of fresh charge.

It has been found that in practice under the conditions described, the operation appears to conform to the second regime in that the presence of the ignition enhancement chamber 40 did not lead to premature ignition of the main charge, even when this charge was near a stoichiometric ratio of fuel-to-air. Once the porous packing material 44 has been preheated by exposure to combustion gases from several cycles of warmup operation, the spark ignition may be turned off and ignition may be continued through the reaction of the gases entering the IEC. One important advantage derived from the structure described and its mode of functioning is that exceedingly smooth operation is achieved even when using very lean charges. Such a desirable state has been observed even though the full ignition of the charge may sometimes occur somewhat later than is most desirable, as indicated schematically in FIG. 2.

When the fuel charge composition was reduced to approximately three-fourths stoichiometric by opening an air bleed downstream of the carburetor (not shown), ignition continued to occur, although prior operation with spark ignition alone was not possible for this fuel-to-air ratio, when the opening 50 to the ignition enhancement chamber was closed.

In the course of the practice of the present invention it has been found that smooth operation is possible even with extremely lean charges in an internal combustion engine provided with the ignition enhancement chamber of the invention, filled with iron particles or other conductive packing.

Through the present invention it is feasible to ignite a lean charge by contact of that charge with an isolated bed of heated material having extensive surface area. An additional important feature derived from the arrangement and method described is that flashback problems are obviated, even when using the customary or usual fuel mixtures.

In some respects, the apparatus of the present invention may be compared with the hot-tube ignition arrangement which has been used for stationary engines, where a nickel tube is attached as an appendix to the combustion chamber and with its remote end heated externally. But there are significant differences. For example, in the prior art arrangement, when the residual gases were forced back into the tube and reactants reached the hot end, near the end of compression, a flame front would be initiated and surge out, consuming the charge. One important difference between this prior art technique and the arrangement of the present invention is that in the system of the invention there is a much greater area of heated surface, thus bringing about a reaction through a diffusional process. That is, even if a flame front could not be sustained, the present invention permits ultimate ignition of the main charge by outflow from the ignition enhancement chamber 40 and mixing of that outflow with the charge in the principal combustion chamber 24 somewhat after top dead center, as indicated schematically in FIG. 2. The present invention provides a time lag so that excess charge may enter the IEC and, upon reaction, is expelled to ignite the main charge. The present invention provides very effective and well-timed ignition, even in high-speed engines.

It is important to appreciate that there are very significant advantages and benefits from the system of the present invention even if its operation is not fully in accordance with the optimal desired mode. For example, if full ignition occurs only after the power stroke is begun, this "late" ignition is to be preferred over no ignition at all as would be the case in an excessively lean mixture intended for spark ignition. That is, if the ignition enhancement chamber 40 of the invention were to serve only as a late ignition backup for spark ignition it would still prevent "missing" along with the discharge of unburned hydrocarbons into the exhaust system, such as occurs in some operating ranges for lean operation near the limits of spark ignition.

It will be evident from the foregoing description that, in accordance with the present invention, even for lean, spark-ignitable operation, the presence of the ignition enhancement chamber assures that no cylinder ever completely misfires. Thus, even if spark ignition should fall in some realm of operation, slightly late ignition would still occur and this would obviate the dumping of unburned reactants into the exhaust gas. The IEC also assures a reasonably effective power stroke and smooth overall operation of the engine. In the moderately lean range, (near $\frac{3}{4}$ stoichiometric) the ignition enhancement chamber reduces the severity of requirements or demands on fuel distribution and spark effectiveness. An added advantage is that the cooler burning lean charge makes it possible to increase the compression ratio.

Still another important benefit of the ignition enhancement chamber of the invention is that there is produced a small time lag in the ignition of the incoming charge. This delay may contribute to the establishment of a sudden expulsion of the combustion gas into the main chamber. Proper exploitation of this phenomenon makes it possible to achieve precise "ignition timing" at higher engine speeds.

B. Hot Surface Ignition in Extremely Lean Engine Operation

The present invention also contemplates improved engine operation utilizing extremely lean, homogeneous charges when the engine is to be run at low fractions of its rated output. The ability to carry out this type of operation makes new and unexpected applications possible. A difference in the operation under conditions of extremely lean fuel systems as contrasted with operation for moderately lean fuel systems is that a larger fraction of the charge must be forced into the ignition enhancement chamber 40 when extremely lean fuel mixtures are used. As before, there must also be a barrier against backflaming so that occasional operation near the stoichiometric region would be feasible. Otherwise, it would be essential that the passages in the porous medium or packing 44 be sufficiently small to ensure that almost full reaction would take place as the charge is forced into the ignition enhancement chamber 40. As first viewed, such operations might seem impractical in that one could expect rapid pressure buildup throughout the compression stroke.

Through theoretical analysis, based upon the extreme case in which full reaction of all the charge entering the ignition enhancement chamber 40 occurs, it may be shown that most of the charge moves into this chamber during the last 5% of the compression stroke. This follows from the fact that the reacting charge expands and prevents the entry of other gaseous materials until the pressure in the principal combustion chamber 24 is quite high. As a consequence, the pressure-volume plot is close to that of an Otto cycle engine. Recognizing that the compression ratio may be raised above conventional values for extremely lean operation, one realizes that the achieved efficiency is good.

The advantages of the present invention are directly adaptable to two-stroke as well as to Wankel engines, and may also be adapted quite readily to small engines such as those used on lawn mowers and pumps, since the invention will materially reduce objectionable air pollution. Moreover, the invention is readily compatible with and may be used with supercharging or turbocharging systems. Indeed, for the engine utilizing extremely lean fuel mixtures, the present invention may be adapted to ensure a high power-to-weight ratio. For example, for fixed turbocharger output it is necessary merely to change the fuel added (thus enriching the mixture above its minimum value) to achieve power encrease. This modification provides rapid response in contrast to throttle-controlled turbocharging of conventional Otto cycle engines.

Because the ignition principle on which the subject invention is predicated is independent of flame front propogation as in the case of spark ignition and independent of ignition lag as in diesel ignition, the invention is conveniently adaptable to and is functional with a variety of different fuels. That is, the engines in which the present invention finds utility include engines which burn fuel oil as well as engines operating on gasoline and J-4, for military use. The present invention makes it possible to reap the advantages of utilizing diesel fuel without the disadvantages of the conventional diesel engine.

The importance of the heat retentive packing material to be contained in the ignition enhancement chamber has been described, various different types of packing being suitable. For example, in engines utilizing an extremely lean fuel-to-air ratio a packing of a catalytic nature may be advantageous to ensure proper functioning of the bed at modest temperatures of about 600° F. Such a capability will cut down the length of time during which an enriched warm-up mixture is required, as well as assuring ignition of the extremely lean mixture. Other considerations dictating the selection of any particular packing are relevant. For example, whereas a catalyst-coated ceramic may be used, conduction of the walls 60 of the IEC is desirable to keep the catalyst temperature within a desired range. Accordingly, metal may be preferred over the ceramic material. Secondly, since a primary purpose of the active surface of the packing 44 is to bring about unselective reaction of the fuel-air mixture, the least expensive medium which can accomplish this at a reasonable surface temperature is to be preferred. For this reason, a base metal catalyst such as nickel is desirable. However, at higher bed temperatures in the range of about 1000° F., it makes less difference what the bed material itself is, since almost all reactants which reach this high-temperature surface will react fully. In addition, one could expect reaction in the vicinity of the hot surface from the outward-diffusing products of the reaction itself. Such a system would be diffusion-controlled and would be almost independent of the microporosity of the catalytic surface.

Figure 1:
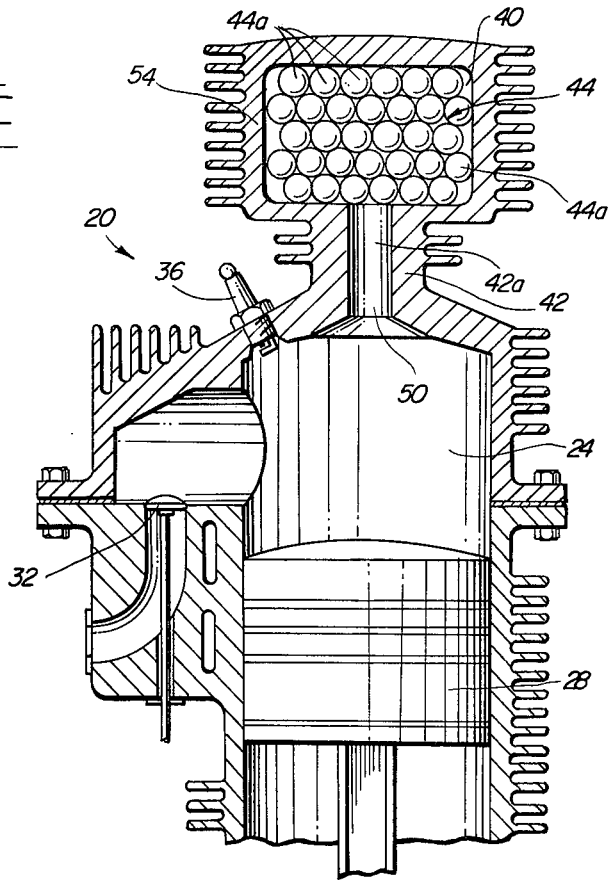
FIG. 1 is a cross sectional view of an internal combustion engine cylinder and piston assembly showing the ignition enhancement chamber of the invention incorporated in and forming a part thereof.
Figure 4:
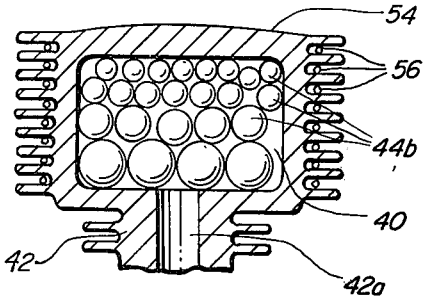
FIG. 4 shows spheres or cylinders of varying diameters as the packing and a heat exchange coil arranged about the ignition enhancement chamber.

It is a practical feature of the invention that the packing material 44 in the IEC need not be of a "catalytic" nature or composition. Excellent results have been obtained using steel filler material of approximately ¼ inch particle size, having 16 square inches of surface and about 1 cubic inch of void space. It has also been found that the ratio of surface area to volume may be markedly less than 16 to 1 and as little as 10 to 1. Additional successful operation has been achieved utilizing as a packing material steel spheres **44*a* of a given size in a range of selectable sizes, as illustrated in FIG. 1. Alternatively, steel balls 44*b* of graded sizes may be used to provide an improved flow path as indicated schematically in FIG. 4**.

Figure 3:
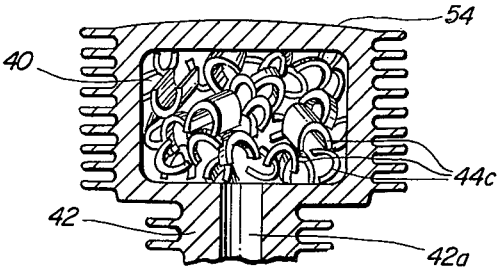
FIG. 3 is the ignition enhancement chamber filled with saddle-type packing.

As an alternative packing material, short cylinders are useful, these having the advantages of easy manufacture from bar stock including stock of different catalytic materials. A preferred packing is saddles **44*c* (FIG. 3**) of the type widely used in the packing of fractionation columns.

Figure 5:
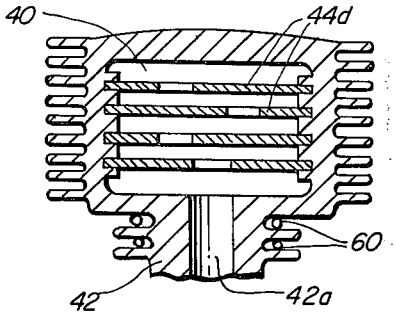
FIG. 5 shows the ignition enhancement chamber packed with horizontally arranged washers having offset openings, and a heat exchange coil about the tube isolating the combustion chamber from the ignition enhancement chamber.
Figure 6:
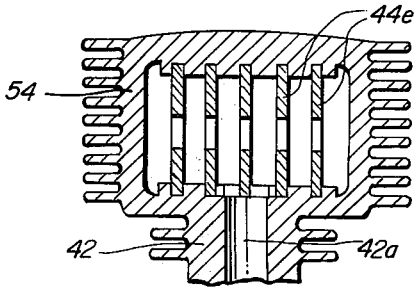
FIG. 6 shows laterally spaced, vertically supported washers as the packing.

A simple material and a simple arrangement of such materials as a packing medium is illustrated in FIG. 5. As shown, the packing material consists of metal washers **44*d*, symmetrical articles of this nature being readily available commercially at low cost. Washers are strong and provide good and controllable heat transfer and good gas flow access while maintaining large surface areas. The surface area may be further extended by scoring the washer faces. Washers 44*e* may be arranged vertically as shown in FIG. 6**.

Figure 7:
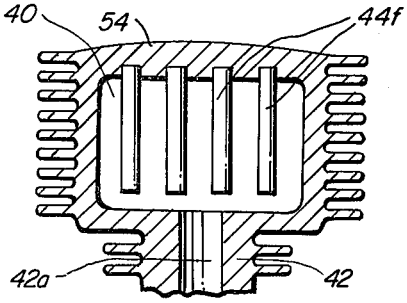
FIG. 7 shows the use of rods as packing for the ignition enhancement chamber.
Figure 8:
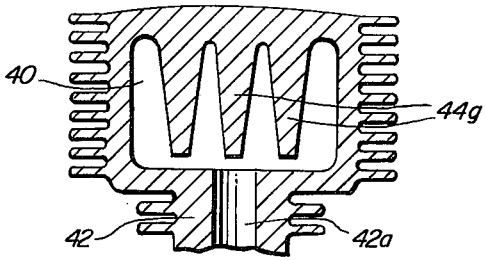
FIG. 8 shows tapered ribs as the heat-retentive packing.

As still another alternative mechanical arrangement, rods **44*f* may be firmly attached to a wall surface 54 of the ignition enhancement chamber 40, as illustrated schematically in FIG. 7. In a variation of this concept, the rods 44*g* themselves may be tapered as shown in FIG. 8** to ensure good flow access. Any preferred mechanical technique may be used for fastening the rods in place, including threading or welding.

Although in the specific embodiments of the invention illustrated the restricted fluid passage of the isolator 42 is shown as a single tube or conduit, the present invention contemplates the use of multiple tubes, slots, and perforated plates or their mechanical equivalents. Likewise, while the washers illustrated are of the type having but a single hole, it is contemplated that other washers having multiple holes and in which the holes may be graded in size will be used. In such an arrangement, the holes in the lowermost washers would preferably be the largest.

External temperature-regulating means such as fluid-carrying coils 56 and 60 may be encircled about the ignition enhancement chamber 40 and about the isolator 42 further to ensure optimum engine operation.

The present invention is not restricted to carbureted operation but contemplates as well manifold injection and even cylinder injection, if such injection occurs sufficiently early to produce an approximately homogeneous charge. It will also be understood that the invention finds utility in both 4-stroke cycle engines and in 2-stroke cycle engines. Nor is the invention restricted to piston engines. Rather, it applies to all positive displacement devices which achieve the same effect as does a piston.

The present invention provides a simple yet highly effective mechanical means whereby the operation of internal combustion engines, particularly engines burning lean fuel mixtures may be markedly enhanced to provide improved operating efficiency and markedly reduced environmental contamination. While, for purposes of disclosure, specific preferred embodiments of the invention have been illustrated and described in detail, many changes, modifications and variations may be made without departing from the spirit of the invention, and all such changes modifications, and variations are included within the appended claims.

What is claimed is:

1. In an internal combustion engine including a combustion chamber and piston means for cyclically compressing a gaseous fuel mixture in said combustion chamber, the improvement comprising control means to regulate ignition firing of a combustible fuel and air mixture in said combustion chamber, and particularly adapted to regulate ignition of a mixture in which the ratio of fuel-to-air is less than stoichiometric, said control means including:

an enclosed substantially fluid tight auxiliary chamber of lesser internal volume than said combustion chamber but at least 5% of the volume thereof, said auxiliary chamber being in gas-flow communication with said combustion chamber but spaced therefrom, isolator means defining restricted fluid passage means interposed between said combustion chamber and said auxiliary chamber to obviate ignition-induced flashback from said auxiliary chamber to said combustion chamber, said isolator means also being operative partially to insulate said combustion chamber from said auxiliary chamber thermally, packing means of heat retentive material dispersed interiorly of and distributed throughout said auxiliary chamber to provide a high surface area-to-volume ratio within said auxiliary chamber, thereby to enhance heat transfer and distribution, said surface area to volume ratio within said auxiliary chamber being at least 10:1.

2. The improvement as set forth in claim 1 and further comprising means externally of said combustion chamber and of said auxiliary chamber for heating said auxiliary chamber and said packing means contained therein.

3. The improvement as set forth in claim 1 wherein said packing means is a metallic substance.

4. The improvement as set forth in claim 1 wherein said packing means is a nickel catalyst.

5. The improvement as set forth in claim 1 wherein during compression of said fuel mixture at least 20% of said mixture is forced into said auxiliary chamber.

6. The improvement as set forth in claim 1 and further comprising external heating means for heating said auxiliary chamber to facilitate ignition of fuel mixtures during start-up of said engine.

7. The improvement as set forth in claim 1 and further comprising cooling means externally of said auxiliary chamber to control the temperature therewithin.

8. The improvement as set forth in claim 1 wherein said cooling means includes a water cooled coil disposed externally of said auxiliary chamber.

9. The improvement as set forth in claim 1 and further comprising cooling means externally of said isolator means to prevent ignition induced backflashing from said auxiliary chamber to said combustion chamber.

10. The improvement as set forth in claim 9 wherein said cooling means constitutes an air-cooled heat exchanger externally of said isolator means.

* * * * *